United States Patent [19]

Berg

[11] 4,372,187

[45] Feb. 8, 1983

[54] NOVEL GUITAR-LIKE ELECTRONIC MUSICAL INSTRUMENT

[75] Inventor: Arne L. Berg, La Puente, Calif.

[73] Assignee: AB Laboratories, a limited partnership, Van Nuys, Calif.

[21] Appl. No.: 259,519

[22] Filed: May 1, 1981

[51] Int. Cl.[3] ..... G10H 3/00

[52] U.S. Cl. ..... 84/1.16; 84/1.01; 84/DIG. 30

[58] Field of Search ..... 84/1.01, 1.16, DIG. 30, 84/1.25, 1.24

[56] References Cited

U.S. PATENT DOCUMENTS

| | | | |
|---|---|---|---|
| 3,999,458 | 12/1976 | Suzuki | 84/1.01 |
| 4,306,480 | 12/1981 | Eventoff et al. | 84/1.16 |
| 4,321,852 | 3/1982 | Young et al. | 84/1.16 |

*Primary Examiner*—J. V. Truhe
*Assistant Examiner*—Forester W. Isen
*Attorney, Agent, or Firm*—Bruce L. Birchard

[57] ABSTRACT

By providing as circuit activators flexible, intentionally damped, vibratory elements, for example strings, the resonant frequency of which may be unrelated to the tone to be generated, while utilizing electronic circuits controlled by such flexible elements for tone generation and modulation, the instrument according to this invention provides a range of "voices," attack, sustain and decay envelopes and other tonal characteristics which cannot be achieved with conventional mechanically resonant systems (such as are found in an acoustical guitar) while providing the performer with the tactility and dynamic expression with which he can identify.

4 Claims, 19 Drawing Figures

NOVEL GUITAR-LIKE ELECTRONIC MUSICAL INSTRUMENT

RELATED CO-PENDING APPLICATIONS

This application is related to my co-pending application Ser. No. 137,550 entitled Versatile Stringless Electronic Guitar-Like Instrument, filed Apr. 4, 1980.

BACKGROUND OF THE INVENTION

1. Field of the Invention

This invention relates to the field of electronic musical instruments.

2. Prior Art

In addition to my prior patent application, the following patents, which have been revealed by a search, are deemed pertinent to my invention but do not anticipate it:

U.S. Pat. No. 3,340,343 (Woll) issued Sept. 5, 1967.

U.S. Pat. No. 3,524,375 (Hopping) issued Aug. 18, 1970.

U.S. Pat. No. 3,555,166 (Gasser) issued Jan. 12, 1971.

U.S. Pat. No. 3,546,353 (Jenny) issue Dec. 8, 1970.

U.S. Pat. No. 3,662,641 (Allen, et al.) issued May 16, 1972.

U.S. Pat. No. 3,694,559 (Suzuki, et al.) issued Sept. 26, 1972.

The Woll patent utilizes key switch actuators as frets which actuate mechanical switches to choose the tone of the simulated string. Such switches do not provide the tactility and expressiveness which are characteristic of my invention. Priority of frets is achieved by single-pole, double-throw switches.

The Hopping patent is addressed primarily to an electrical musical instrument which utilizes a pressure gradient switch for voicing control and is unrelated to this invention.

The Gasser patent utilizes hard-contact switches on the neck of the instrument, even as Woll did. The problems of such switches have been recited in connection with the discussion of Woll.

The Jenny patent is directed to an electronic musical instrument in which tone is chosen by means of a conductive stylus or probe. Such an instrument would be difficult to play for a musician skilled in guitar playing.

Allen uses capacitive switches for pitch selection and no prior circuit is shown or suggested. My invention utilizes capacitive sensing for damping tones rather than for pitch selection. Piezo electric elements in combination with strings amplitude modulate the output signal of the instrument. No such Piezo-electric elements are essential in my device.

Suzuki utilizes variable resistor fingerboards coupled to variable frequency oscillators, with the frequency being a function of the pressure applied to the fingerboards. No touch sensor damping switch is utilized in the Suzuki device or in any art known to applicant.

A monophonic instrument has also been announced very recently by a company called Oncor Sound, Inc. of Salt Lake City, Utah. The date of the development of this instrument is unknown but is believed to be very recent. It relies on a grounded metal back on the arm or neck of the instrument, which is held in the left hand. Its literature says, "when the frets are touched, the potential is sufficient to switch them on." Again, the date of this development is unknown, but, because it has only recently been announced, it is believed to be of recent vintage. The right hand or strumming portion of the instrument describes "an improved sensor for pick-up on the strum action." Further, it describes "perfect contact from the strum bar to the sensor." I do not use any such structure and my instrument is polyphonic. Further, the ONCOR system lacks tactility and expressive capabilities.

In a conventional mechanically-tuned string instrument, the strings are manually excited in a manner known as picking, plucking, or strumming. The extent to which the string or strings are excited determines the sound pressure level emanating from the string, while the attack, decay and tone characteristics are a function of the entire mechanical system and, therefore, are relatively fixed for a given instrument. In addition, the conventional instrument provides for "snubbing," which is the manual damping of the resonating system by placement of the hand or finger directly onto the vibrating string, as well as the frequency modulation effects that are introduced by the "bending" of the string.

With the exception of the limited control of attack, decay and tone, the aforementioned elements provide the performer with a great deal of musical expression utilizing simple techniques, and probably account largely for the guitar's popularity. The evolution of the electric, or amplified guitar and related tone modifying systems, plus the more recent synthesizer techniques which have been applied to the conventional stringed instruments, illustrates a popular desire to expand the more limited nature of their mechanical systems. The majority of these approaches rely on the mechanically tuned string as the tone generator, and therefore are inherently limited as to tone structure and envelope, and in many cases, suffer in response time.

Therefore, it is an object of this invention to provide an improved electronic musical instrument.

It is a further object of this invention, to provide an instrument, the tone structure, envelope, pitch and range of which are electronically generated, yet which preserves the important tactile elements familiar to the fretted instrument player, and more importantly, allows the inflection of expression typical of stringed instruments.

SUMMARY OF THE INVENTION

By providing, for both the right and left hand, flexible control or activator elements which, though not tone generating in themselves, permit control of the tone generated in the fashion and to the extent achievable with acoustical instruments, the versatility of "voices" achievable with electronic tone generation is realized while preserving to the performer the familiar techniques of "bending," "snubbing" and variable force "picking" which permit him a full range of dynamic expression, with the tactility he experiences when playing a conventional instrument.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by references to the following description taken in conjunction with the accompanying drawings, in which:

DETAILED DESCRIPTION OF THE PREFERRED EMBODIMENTS

Figure 1:
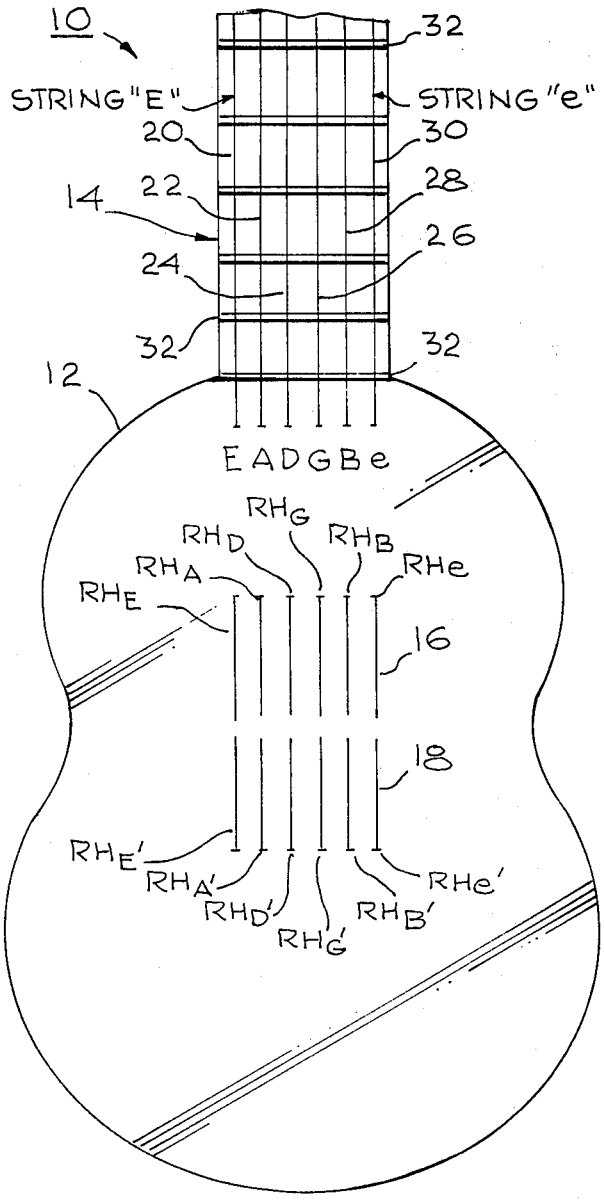
FIG. 1 is an outline drawing of a portion of an instrument according to my invention.

In FIG. 1, instrument 10 has body 12 and neck 14. Body 12 has thereon sets of body-sited activator elements 16 and 18. The number of elements in each set corresponds to the number of "strings" in the instrument. In the case shown, there are six "strings."

Those "strings" are "E", "A", "D", "G", "B" and a two-octave higher "e". Each set of right-hand or body-sited activator elements (registers) 16, 18 controls a set of tones with a predetermined waveform, for example, sine wave of square wave. Though the number of sets shown is two, as many sets may be provided as waveforms are desired. The different waveforms, of course, give different tonal effects, or "voices." The construction of the activator elements in sets or registers 16 and 18 will be described in connection with FIG. 2.

Neck 14 carries strings 20, 22, 24, 26, 28 and 30 thereon, not resonant to but controlling, in conjunction with the elements in sets 16 and 18, the tone generators having "open string" tones of "E", "A", "D", "G", "B" and "e" (two octaves (higher than "E"). Strings 20 thru 30 are electrically conductive. Neck 14 also carries metallic frets 32 thereon oriented transverse to strings 20 thru 30. Strings 20 thru 30 permit tone "bending" and "snubbing" as well as frequency determination, as will be described more fully hereinafter.

Figure 2C:
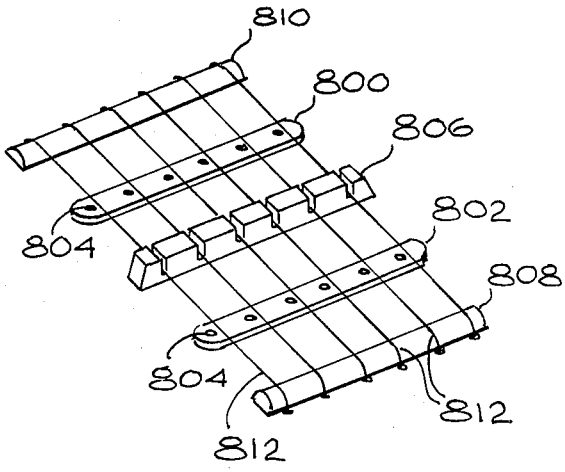
FIG. 2C is a schematic drawing, in perspective showing the combination of a number of activator elements in a body-sited activator or right-hand control structure.
Figure 2B:
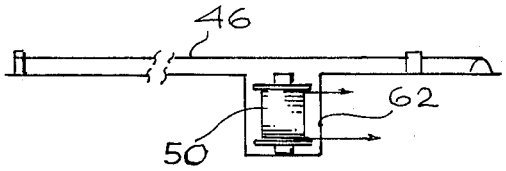
FIG. 2B is a schematic drawing of the location in my instrument of the activator element of FIG. 2A.
Figure 2A:
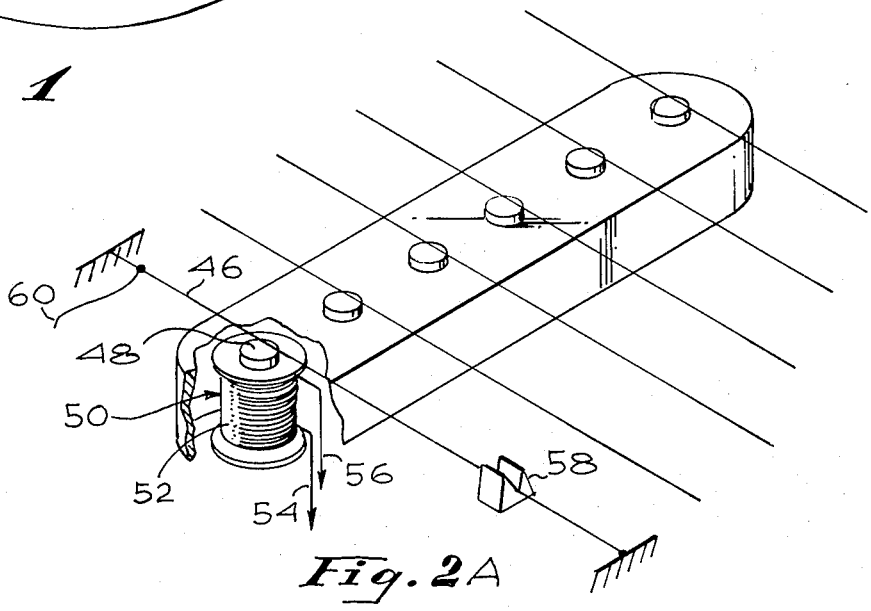
FIG. 2A is a schematic drawing of a body-sited activator element for use in my invention.

In FIG. 2A, string 46 is of a metal with a ferrous content so as to exhibit magnetic characteristics. It should also be resilient and have a thickness resembling the thickness of a conventional guitar string, so as to give the performer the feeling that he is playing a familiar instrument.

In proximity to string 46 is the pole 48 of permanent magnet 50 around which is wound pick-up coil 52. When string 46 is plucked the reluctance in the return path of the flux from pole 48 of magnet 50 is varied and an output electrical signal is derived from leads 54, 56. This signal is used to control associated envelope-generating and tone-generating electronic circuits, which will be described more fully hereinafter.

Since string 46 performs primarily switching and instrument-output amplitude control functions, only the amplitude of the first peak in its oscillations following being plucked, is important. Any further peaks are, in actuality, undesirable, as can be seen from FIG. 5. As a result, string 46 is intentionally and heavily damped by damping block 58, which may be made of rubber, for example.

Six such body-sited variable-reluctance activators are provided for each register, 16, 18, as shown. Each register shown in FIG. 1 is associated with a pre-determined waveform or "voice" of instrument 10.

Touch sensing signals can be taken off string 46 through lead 60.

The position of the magnetic portion of each body-sited activator, including magnet 50 and string 46 can be seen more clearly in FIG. 2B. Magnet 50 and its associated winding 52 are supported in a recess 62 directly below an associated string 46. In FIG. 2C, pick-ups or registers 800 and 802 each comprises a plurality of reluctance pick-up elements 804, one for each string. Separator 806 isolates the string motion to the picked area only. Elevating bridges 808 and 810 elevate strings 812 for picking purposes.

Figure 3:
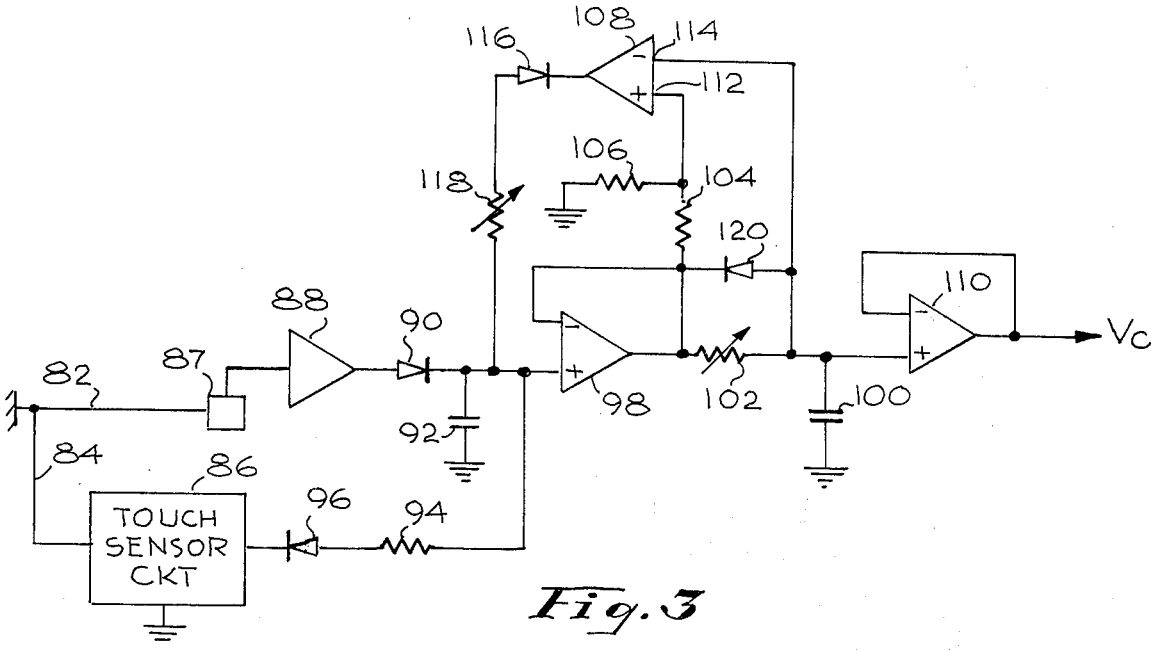
FIG. 3 is a schematic diagram of an envelope generator for use in my invention.
Figure 6:
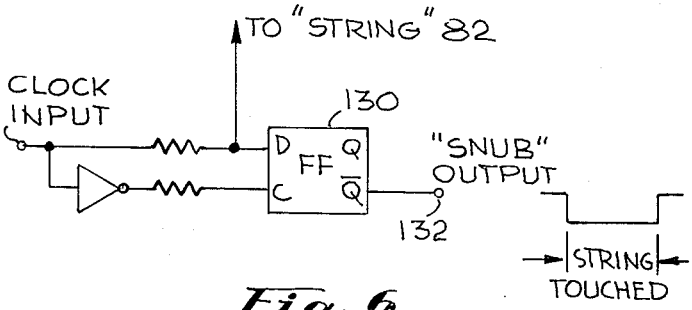
FIG. 6 is a schematic diagram of a touch sensor for use in my invention.
Figures 1, 7:
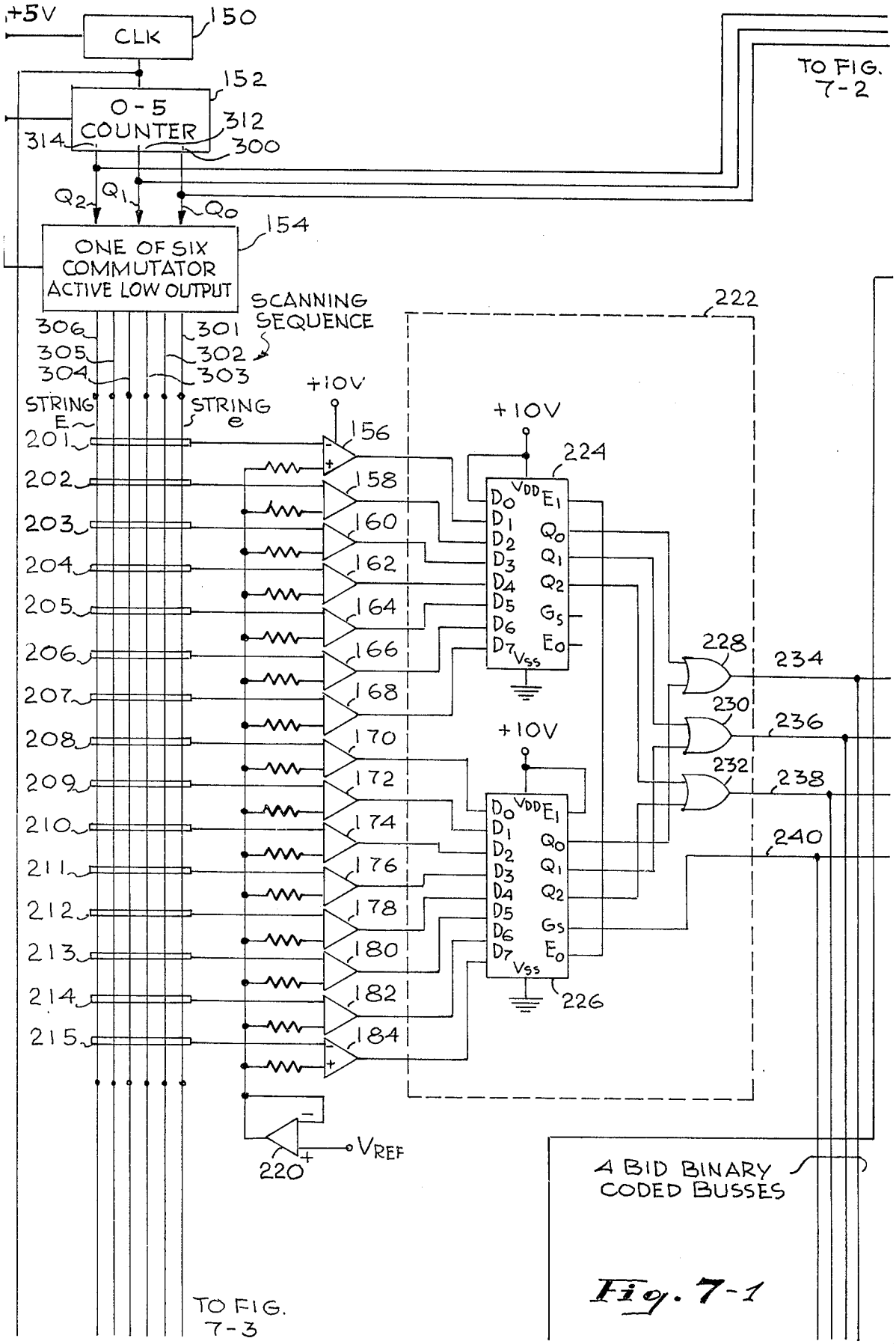
FIG. 7 is a schematic diagram of a musical instrument according to my invention.
Figures 2, 7:
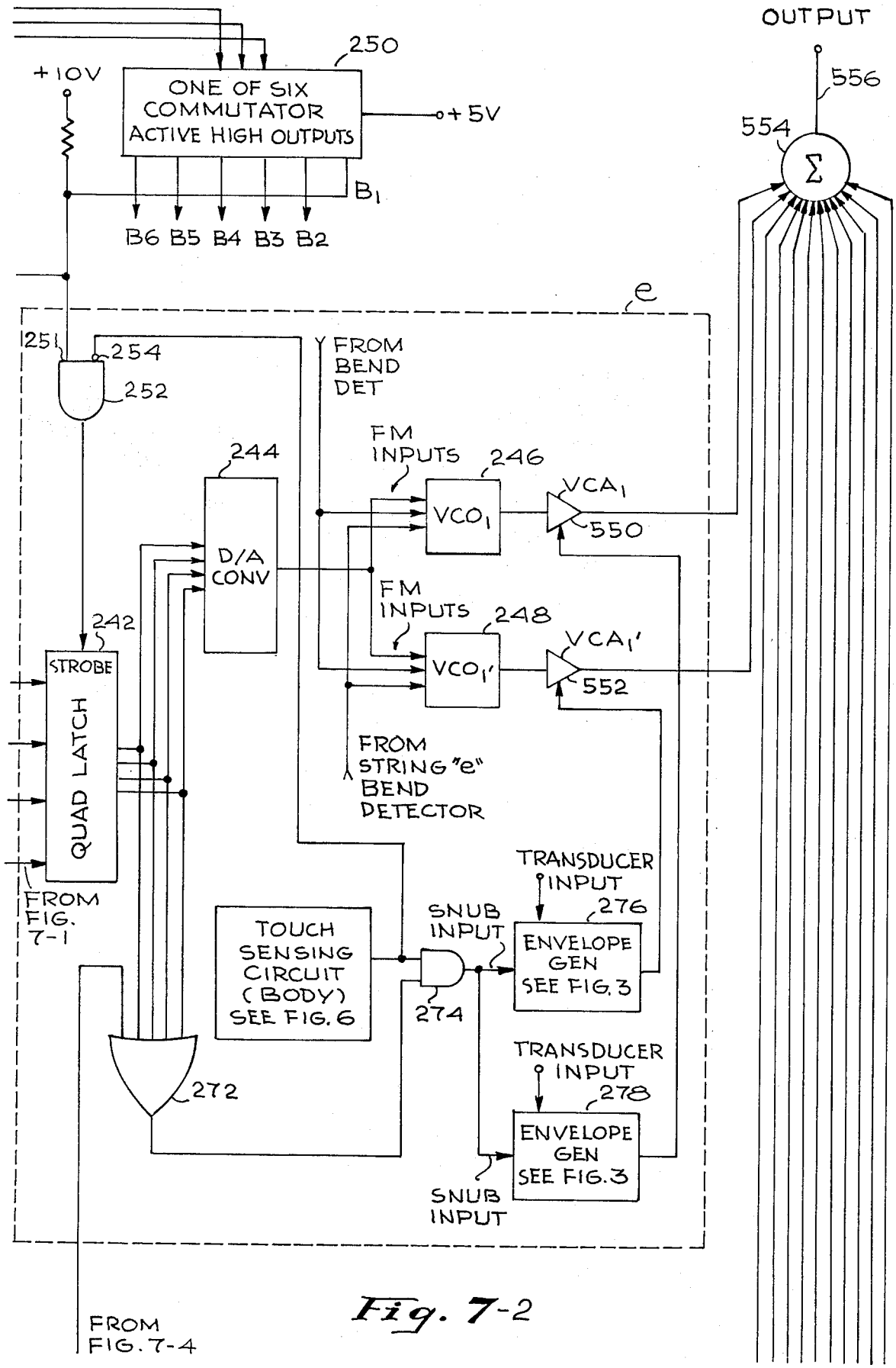
Figures 3, 7:
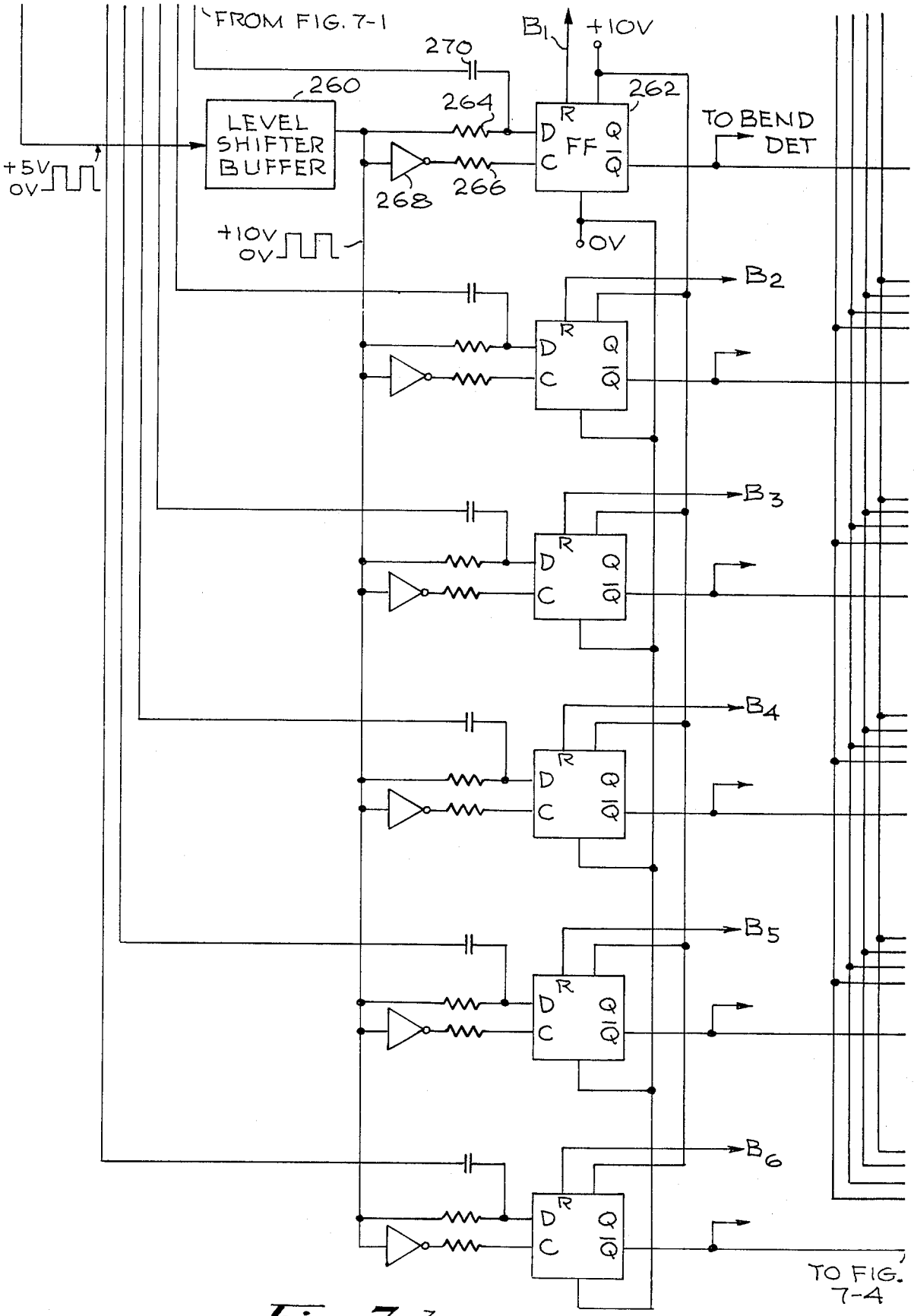
Figures 4, 7:
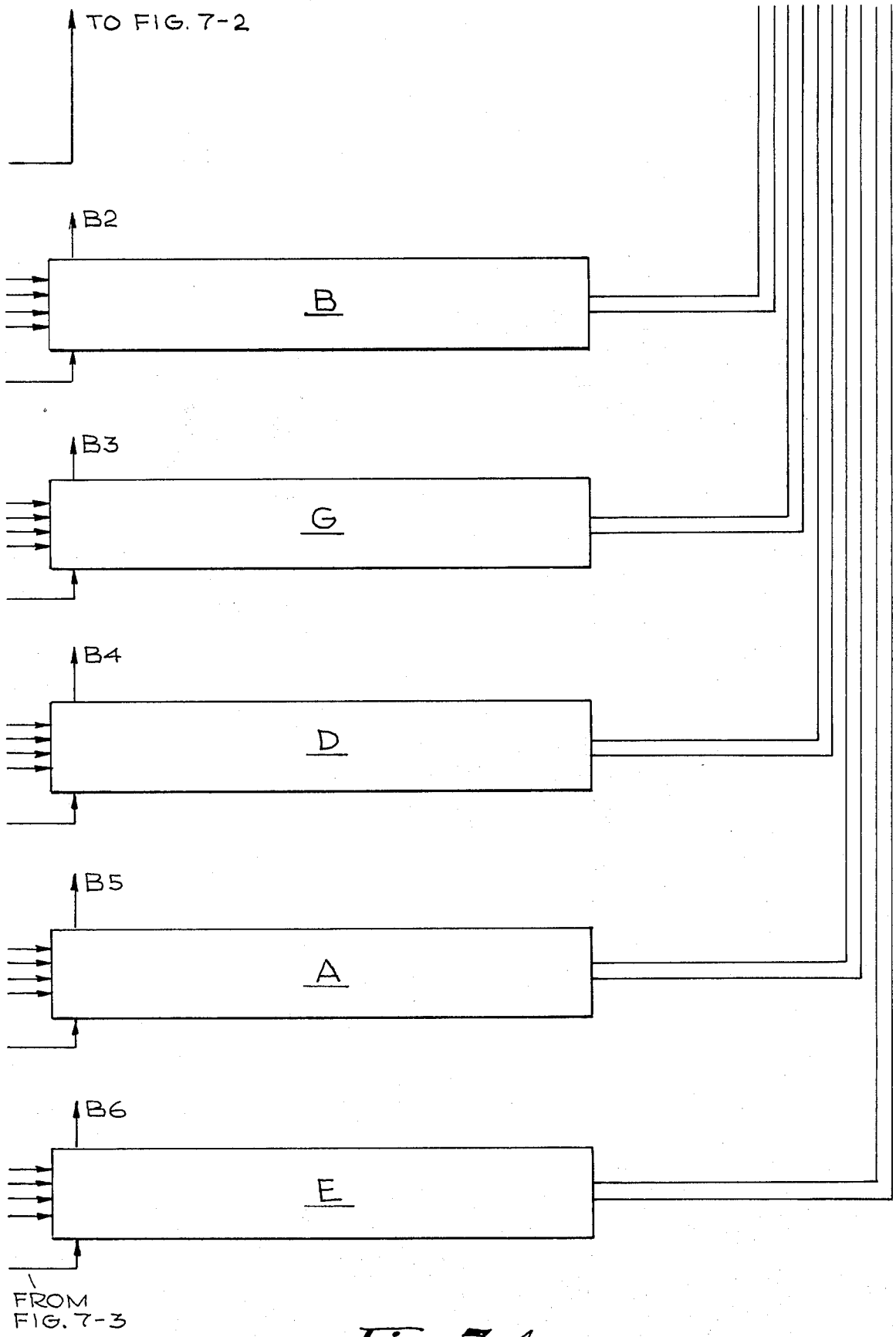

An envelope generator which could be coupled to the body-sited activating element of FIG. 2 (or to a Piezo-electric version thereof) is shown in FIG. 3. In FIG. 3, flexible element 82 is coupled electrically through lead 84 to touch-sensing circuit 86, which will be described in connection with the discussion of FIG. 6. The electro-magetic transducer of FIG. 2 may be used for picking sensor 87. Any of the commonly known transducers, such as electromagnetic, magneto-resistive, capacitive or resistive types, may be used.

Figure 4:
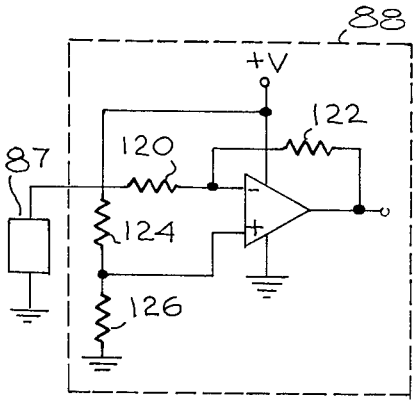
FIG. 4 is a schematic diagram of a portion of the circuit of FIG. 3.

The transducer is mechanically coupled to the flexible element 82 so that it is excited by the finger or fingers either directly, or indirectly via an attached string as previously described, and the combination is essentially an intentionally damped vibratory system. The period, or resonant frequency of the system however, is inconsequential with regard to the pitch or tone of the instrument. Damping of the vibratory system is preferably very high so that short-decay envelopes may be preserved in the circuit of FIG. 3. The transducer is buffered by the pre-amp and buffer 88 shown in FIG. 4. Gain may be derived from pre-amp 88, if necessary. FIG. 4 illustrates an example of such a pre-amp, buffer. In normal use, the playing sequence is as follows: the transducer system equivalent to a string, is stressed by one's finger, then released to vibrate. During the time the system is stressed, but prior to release, the touch sensing circuit 86 detects the presence of the finger and its output goes "low." This "low" forward biases diode 90, and, therefore, bleeds any charge remaining on capacitor 92 via resistor 94. When the finger is removed and the flexible activating element is released, the transducer's damped oscillatory wave train which results is passed by pre-amp 88, and is then peak detected by diode 90 and capacitor 92. The degree to which the transducer 87 was stressed before it was released and, therefore, the velocity with which it returns determined the voltage level which is peak-detected. After the flexible element is released, touch-sensor circuit 86 detects no body-capacitance present, and its output returns to its normal high state. This reverse biases diode 96, terminating it as a discharge path for capacitor 92. Buffer 98 provides a high input impedance, and therefore little discharge path to capacitor 92. The equivalent voltage seen on capacitor 92 is now available at the output of buffer 98 and endeavors to charge capacitor 100 via the variable attack resistor 102. Simultaneously, this voltage is made available to a resistive divider consisting of resistors 104 and 106, and then to the non-inverting input terminal 112 of operational amplifier 108, configured as a voltage comparator. Assuming a finite resistance has been imposed by the adjustment of the variable attack resistor 102, it can be seen that the charging rate on capacitor 100 is a function of this RC time constant. The rising voltage seen on capacitor 100 is a function of this RC time constant. The rising voltage seen on capacitor 100 therefore, constitutes the attack part of the envelope which has been selected and is available at the output of buffer 110. This rising voltage is also presented to the inverting input terminal 114 of the voltage comparator 108, and its output remains high until this rising voltage reaches the same value that is at its non-inverting (+) input. When the charge on capacitor 100 is sufficient, the voltage at the inverting input will equal, or slightly exceed that at its non-inverting input, thereby switching its output low. This "low" forward biases diode 116, and consequently begins discharging capacitor 92 via the decay control 118. The decaying voltage is reflected at the output of amplifier 98 which forward biases diode 120, forming a dicharge path for capacitor 100. In this way, the discharge rate of capacitor 100 follows that of capacitor 92 and is reflected at the output of amplifier 110, forming the decay portion of the envelope. Simply stated, the overall result of this circuit of FIG. 3 is to provide independently adjustable attack and decay characteristics, where the preselected attack time is allowed to complete its cycle before the decay cycle is initiated, while allowing envelope amplitude control (dynamics). Further, the self-adjusting threshold level of the voltage comparator circuit allows stable attack and decay characteristics over a wide range of envelope amplitudes. In addition, the envelope may be squelched at will by touching the activating system, creating a string "snubbing" effect not unlike that obtained from a conventional stringed instrument. No such circuit is believed to have existed prior to my invention thereof.

In FIG. 4, pre-amplifier, buffer 88 takes its input from transducer 87. Low frequency cut-off is desirable to make the circuit relatively insensitive to the initial bending or displacement of the body-sited flexible element 82 before that element is released. Resistors 120 and 122 are chosen for the required gain which varies with the transducer used, the mechanical system to which it is attached, and the sensitivity desired.

Resistors 124 and 126 are chosen to set the required quiescent output voltage, which may be set to some margin below the threshold level of the voltage controlled amplifier to which it is coupled (see FIG. 7), thereby providing some insensitivity to external shock excitation.

Figure 5:
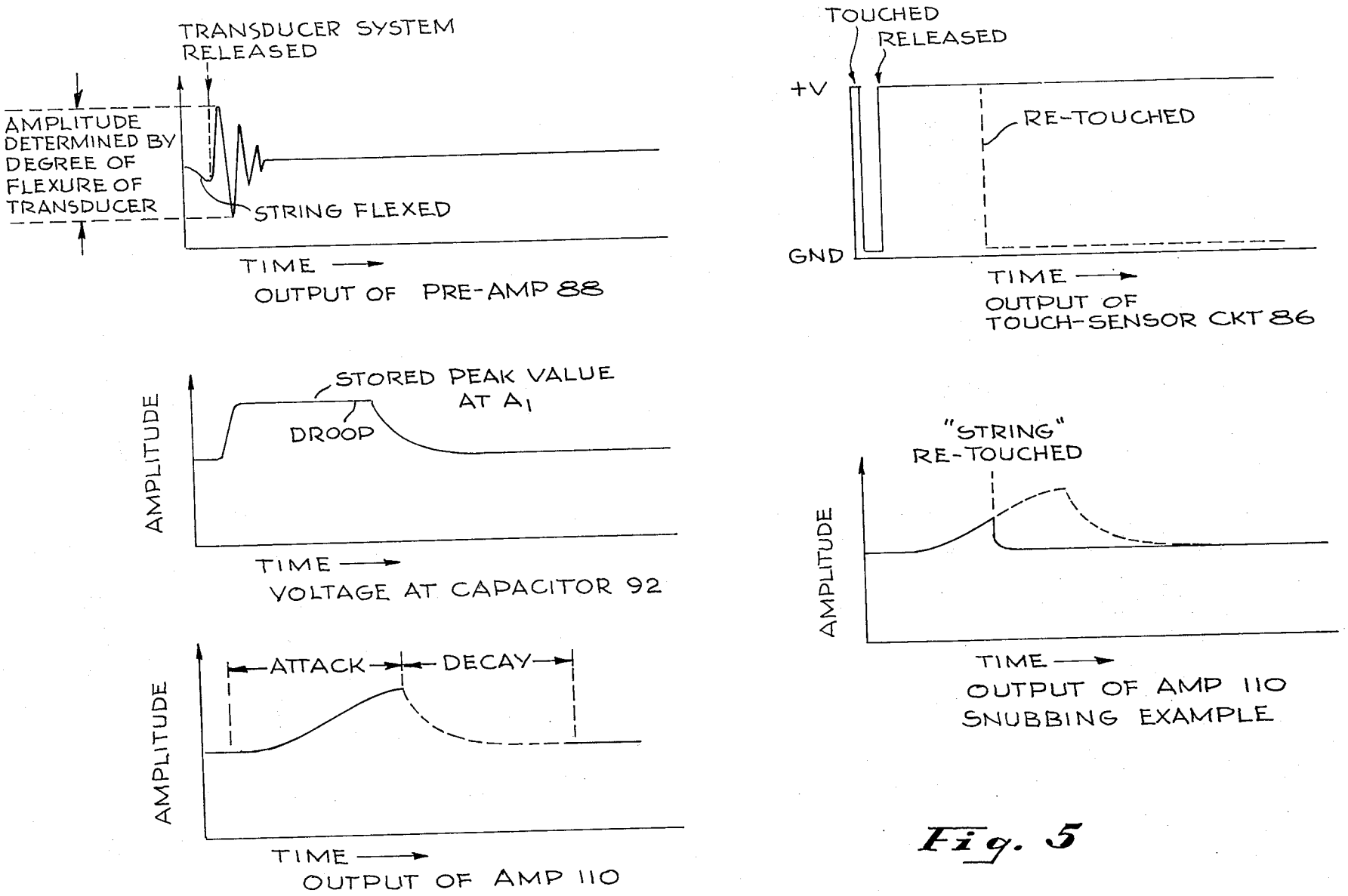
FIG. 5 is a graphical representation of the response of the circuit of FIG. 3.

Some timing diagrams for the circuit of FIG. 3 are shown in FIG.5 and are self-explanatory.

A capacitive type of touch-sensor circuit 86 is shown in FIG. 6. A "D" type of flip-flop 130 has clock input, with inverted polarities but of equal amplitudes, applied to its C and D input terminals.

When "string" 82 is not touched, flip-flop 130 remains balanced and stable. When "string" 82 is touched, capacity is added to terminal D, slowing down the rise and fall times of clock pulses at D with respect to C because of the RC time constant then existing, and flip-flop 130 is toggled, causing terminal Q to go negative, as shown in FIG. 6, to produce a "snub" output at terminal 132.

In the instrument according to my invention, the neck assembly provides pitch selection, by pressing one or more strings against the appropriate frets. As with a conventional guitar, strings which are not "fretted," provide a standard "open-string" pitch, when they are asked to "speak" by picking with the opposite hand. Each fret position alters these pitches ½ step (semitone) up as one progresses towards the body of the instrument. A technique called "bending," "string bend," or "pitch bend" is also often utilized in the playing of the instrument. To produce "pitch bend" the performer imposes a lateral displacement of a string (or strings) while it is fretted. In the conventional instrument, this results in an increased tautness which slightly raises the natural resonant frequency of the string. Another playing technique often utilized on the neckboard, is the selective damping or muting of certain strings (which are not desired to be heard) while the opposite hand strums all of the strings in a sweeping manner. This is accomplished by placing the hand or fingers on the selected strings, but without sufficient force to cause them to contact a fret.

The remaining circuitry to be described in connection with FIGS. 7, 9 and 10 encompasses the previously cited effects of pitch selection, bending and damping, in a manner similar if not identical to the techniques utilized in the playing of a tuned string instrument. It should be appreciated however, that these techniques are derived from the subject instrument whose strings or activators are not of themselves, the tone generators. Rather, these strings or activators are the medium for control of an electronic tone generating system. Further, according to my invention, the instrument incorporates time sharing or multiplexing of the neck string circuitry, which greatly reduces the number of connections and components in an otherwise discrete approach. This multiplexing scheme is, as well, coordinated with a neck string snubbing system in a unique manner, to be described hereinafter.

Figure 8:
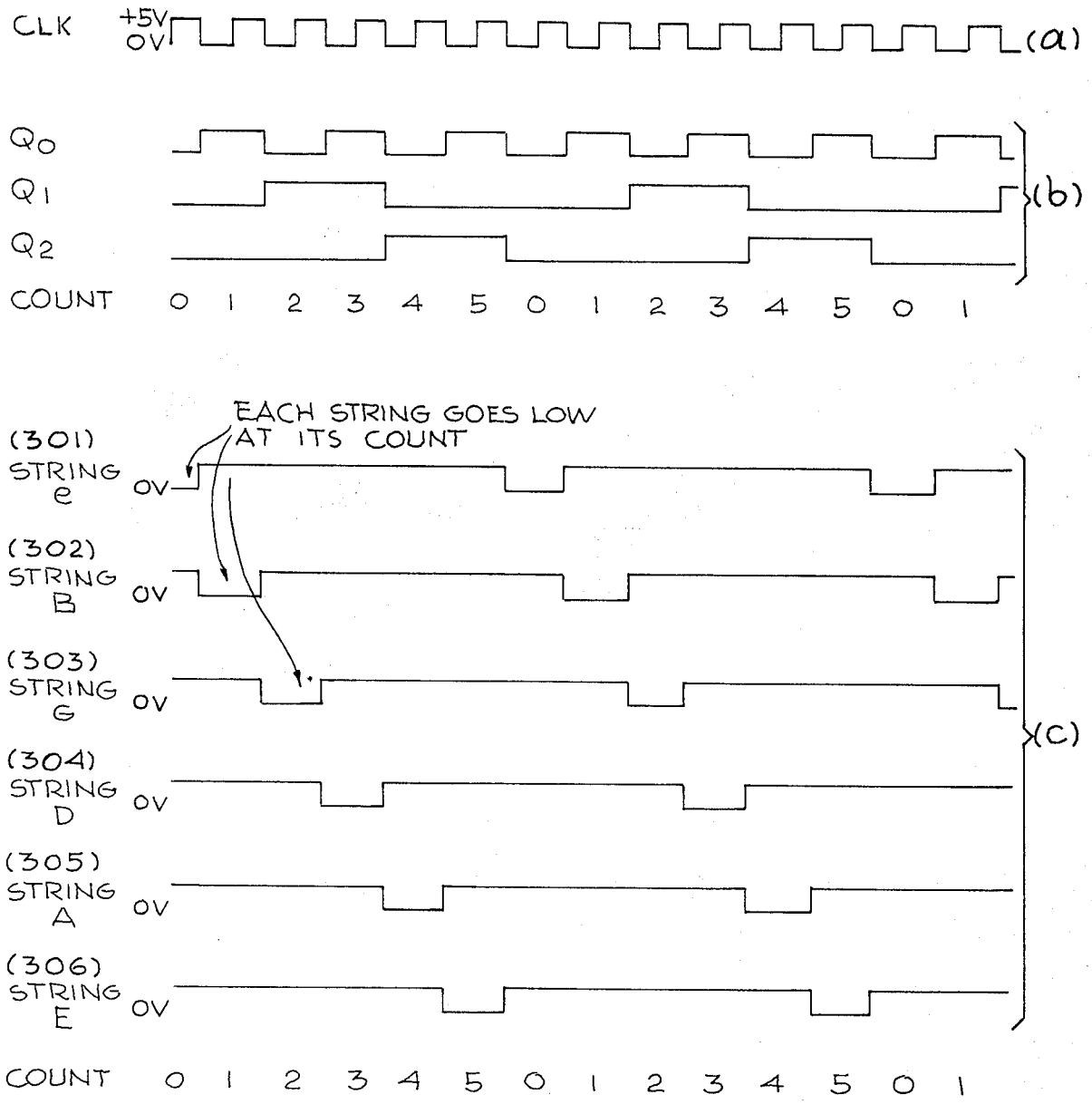
FIG. 8 is a timing diagram for the circuit of FIG. 7.

Referring to FIG. 7, the clock 150 is a square wave free running oscillator which switches from 0 volts to +5 V (See (a), FIG. 8). While operating voltages are arbitrary, or depend upon the types of devices used (CMOS, T.T.L., etc.), relative voltages between various circuits are important in the particular embodiment shown, as will become obvious later. For this discussion, two primary power supply levels will be used; +5 volts and +10 volts. Both share the same common (0 volts).

The clock output takes two paths. One is to an up-counter 152 which provides a 0 to 5 binary output for six counts of the clock and repeats endlessly ((b), FIG. 8). This is typical of devices such as the 7490 T.T.L. integrated circuit, wired in a ÷6 configuration. This 3 bit output is then decoded by the commutator-scanner or multiplexer, (type 7441 T.T.L., for example) designated 154 in FIG. 7, whose 6 outputs are sequentially brought to zero volts. It will be noted that this commutator provides a "low" to each string at the selected output. This clock, counter, scanner combination is described here for convenience in analyzing the total circuit. Such multiplexing scanners are well known and need not be described further here. However, their use in the overall circuit of this instrument is unique, as can be seen from the discussion which follows:

In one configuration of this invention, i.e., in the configuration of FIGS. 7 and 9, frets are located under the six strings with geometry familiar to the musician. They are conductive elements which are contacted by the strings (also conductive) when the player chooses. Fifteen frets are used in the example, providing 16 pitches per string when "open string" pitch is included.

Each fret 201–205 is connected to a respective op-amp 156 thru 184 wired as a sensing switch. While these op-amps are not essential to the invention, they are incorporated here to provide inversion, increase contact sensitivity and to provide a level shift for the subsequent circuitry. Other common interface circuitry could be utilized. A common voltage reference (VREF) is supplied to each, which may be set at approximately +2 volts, depending on desired sensitivity, and the particular device's switching threshold requirements. The reference voltage is developed and buffered by amplifier 220. The outputs of amplifiers 156 thru 184 are normally "low."

The 15 op-amp outputs from op-amps 156 thru 184 are connected to a 15 line priority encoder 222. In the example, 2, 8-line priority encoders 224 and 226 in conjunction with 3, 2-input or gates 228, 230 and 232, make up this 15 line encoder utilizing popular CMOS devices, such as CMOS 4532. Four lines 234, 236, 238 and 240 are thus derived from this encoder, which provide a binary number equivalent to the fret positions, as numbered. If fret number 202 is brought low, a binary "two" will result, or 0010. The priority hierarchy is designed so that if any two or more frets are brought low simultaneously, only the highest fret position will be encoded.

In a normal playing mode, these frets of course, are brought low by contact with the strings. Recalling that the strings are brought low sequentially by the scanning multiplexer, it can be seen that the priority encoder output busses will output binary fret numbers in the same sequence. Thus, assuming string "e" is made to contact fret 205 for example, and simultaneously string E is made to contact fret 208, the following binary sequence can be found on the busses:

| | | | Priority Encoder Outputs | | | | |
|---|---|---|---|---|---|---|---|
| Commutator | Count | String "Low" | MSB | | | LSB | |
| 0 | 1 | e | 0 | 1 | 0 | 1 | = 5 |
| 1 | 2 | B | 0 | 0 | 0 | 0 | = 0 |
| 2 | 3 | G | 0 | 0 | 0 | 0 | = 0 |
| 3 | 4 | D | 0 | 0 | 0 | 0 | = 0 |
| 4 | 5 | A | 0 | 0 | 0 | 0 | = 0 |
| 5 | 6 | E | 1 | 0 | 0 | 0 | = 8 |

Ultimately, the binary codes are to be converted to an analog signal for the purpose of generating proper musical pitches in a series of voltage controlled oscillators. This also requires a linear-to-exponential conversion process, techniques for which are well known and need not be described here. The codes must also be sorted out relative to the string from which they are initiated, and sent to the V.C.O. controlled by that string. On the assumption that string "e" is made to contact fret 205 the circuit analysis will continue:

The 4 bit binary output busses 234 thru 240 are parallel-connected to 6 quad latches, corresponding to the six "strings," each capable of being "strobed," or allowed to pass the data at their inputs, when the strobe inputs are high. To avoid unnecessary repetition, only quad latch 242 is shown. When the strobe inputs are low, they will latch or store the data last seen at their inputs, and present this stored data at the outputs. This data (the binary representation of fret positions), is converted to an analog, or step-voltage equivalent to the binary value in the respective D to A converters, only one of which 244 (corresponding to the "e" string), is shown. Each D to A converter provides the control voltage to one or more voltage controlled oscillators (V.C.O.) For example, D to A converter 244 supplies control voltage to V.C.O.'s 246 and 248. Each oscillator, or set of oscillators provides the frequencies and tones for each given neck string. The oscillators employed must be of the type which contain the necessary logarithmic conversion for yielding accurate musical half-tone steps, or such conversion must be disposed between the A-D converter and the oscillators V.C. input.

Returning to the 0 to 5 counter 152 previously described which runs the string scanner, note that it is simultaneously running a second similar scanner 250 in parallel. Commutator 250 is configured to provide active high outputs however, with a high level shift to 10 volts. Optionally counter 152's outputs could be inverted to achieve the active high and level-shifted signals. Outputs $B_1$ through $B_6$ therefore go high in synchronism with respective strings 301 thru 306 ("e" to "E"), when the strings go low. With string "e" in contact with fret number 205, amplifier 164's input is brought low when the commutator brings that string low. At that moment, the 4-bit busses present the binary number 5 (0101) to all six quad latch inputs. Simultaneousy $B_1$ of commutator 250 is high, and is presented to one input 251 of gate 252. Assuming for the moment that gate 252's other input 254 is low, quad latch 242's strobe input therefore goes high, and the latch 242 is instructed to pass the 0101 code at its inputs. Since outputs B2 to B6 of commutator 250 are low at this time, the remaining 5 quad latches will not pass this data, so string "e's" status has only been passed to the first latch 242 and its attendant D/A converter 244, and V.C.O.'s 246 and 248.

In the foregoing explanation, gate 252's second input 254 was presumed to be low in order to follow through on the circuit activity presented. In fact, this input is brought low as a result of having picked, strummed or otherwise touched activating elements RHe or RHE on body 12 as outlined in connection with FIGS. 1 thru 5. Had these elements not been touched, the upper quad latch would not have been strobed, and therefore string "e's" status would not have influenced the pitch of the instrument. The picking sequence can be seen then, to initiate an update of the status of each fret and string. This feature is selectable and can b e defeated by switch $S_1$.

Since the instrument according to my invention utilizes physically independent neck and body sensors (it is played, however, as though they were physically continuous members), a separate snubbing system is utilized on the neck strings (the picking sensor snub system has already been described). The basic sensing circuit applied here is a capacitive system similar to the circuit of FIG. 6 and consists of six "D" type flip-flops, each assigned to one of the six strings. (Three dual CMOS 4013's would be a good choice). The flip-flops are cocked from the same oscillator 150 that is used for the commutator circuit, but is level shifted to 10 volts, and buffered, by level shifter 260. The D and C inputs of flip-flop 262 are presented with the buffered clock signal via resistors 264 and 266 with the "C" input inverted by amplifier 268. The "D" input of each flip-flop is connected to its associated neck string via blocking capacitor 270. Stray circuit and wiring capacity in conjunction with resistor 264 form a low pass filter affecting the waveform slightly at "D". Resistor 266 is chosen to provide a similar low pass filter to the inverted clock signal at C, in conjunction with the input's inherent capacity. The resulting signals at "D" and "C" are quite similar, but of opposite phase, and the flip-flop is not toggled. When the "low" scanning level is applied from commutator 154 to string "e", commutator 250 output $B_1$ simultaneously provides a high level to the reset (R) input of the associated flip-flop, insuring that it will not get toggled during this scan. Now, assuming that a finger is placed on string "e", but the string is not depressed sufficiently to contact a fret; body capacitance increases the capacitive loading on input "D", effectively delaying the signal with respect to input "C" of flip-flop 262. When string "e" is not scanned "low," the flip-flop will toggle, and the Q output switches "low," and this "low" will be presented to one of five inputs of OR gate 272. The remaining 4 inputs of OR gate 272 are "low" as a result of an open-string code at the quad latch (0000), and OR gate 272's output is consequently, "low." This "low" is presented to one input of AND gate 274, insuring a low output which then proceeds to activate the snubbing inputs of envelope generators 276 and 278. The final result being muting the V.C.O. outputs, as was described earlier.

If the foregoing conditions are repeated except that string "e" (301) is made to touch a fret, when this fret position is strobed "on" at the outputs of the quad latch, one or more of these outputs must be high, and therefore the output of OR gate 272 must go high, and consequently the output of AND gate 274 will also go high. This "high" inhibits the snubbing function.

The commutation of strings can be seen clearly in the timing diagram of FIG. 8. Signals $Q_o$, $Q_1$ and $Q_2$ (FIG. 8*b*) are derived from the output terminals 300, 302 and 304, respectively of counter 152 and are fed to string commutator 154. Each string 301 thru 306 goes "low" at its count, producing the waveforms shown at C in FIG. 8.

"Pitch bending"0 is achieved in the circuit of FIG. 7 by means of the transducers described in FIG. 9. Each "bend" transducer's function is simply to apply a change in D.C. value to the F.M. input of its respective V.C.O.'s, such as V.C.O.'s 246, 248, which is proportional to the transducer's displacement.

While this would function as stated, there is a practical problem with this simple approach. If the bend transducer's mean value or mean output level (at rest, or not "bent") were a repeatable value, the V.C.O's pitch would in turn be repeatable, and only influenced by the other tuning elements, as outlined, and the V.C.O.'s inherent instabilities, which can be kept reasonably small. However, in practice it can be seen that errors in the reference position of the bend transducer will accumulate as a result of factors such as temperature changes, string fatigue, spring fatique and mechanical wear as well as a result of the transducer's resolution limitations. To reduce the effects of these problems, the following interface circuit is disclosed.

While any of the commonly known transducers may be applied, the one cited here is of the variable resistance (potentiometer) type (See FIG. 9). The potentiometer may be either of the rotary type shown in FIG. 9B or of the linear type shown in FIG. 9C. In FIG. 9B, potentiometer 400 has actuating arm 402 coupled to its shaft 404. A string 406 is mechanically coupled between actuating arm 202 and a post, not shown. String 406 is held in tension by spring 410. A stop 412 is provided to limit the travel of actuator arm 408. Electrical connections are made to terminals 414, 417 and 418. The center arm or slider (not shown) of the potentiometer is connected to terminal 416.

Figure 9C:
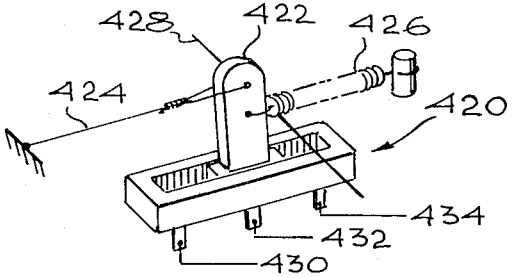
FIG. 9A is a diagram, partially in perspective, partially cut-away and partially schematic, of an instrument according to my invention, showing associated tone "bending" apparatus and right and left hand activator elements.
FIG. 9B is a schematic diagram of an alternate form of "bend" transducer.
FIG. 9D is an expanded view of a portion of the apparatus of FIG. 9A.
FIG. 9E is a schematic diagram showing the method of producing "bending,"
Figure 9B:
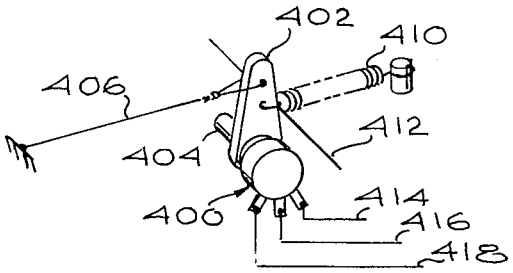
Figure 9A:
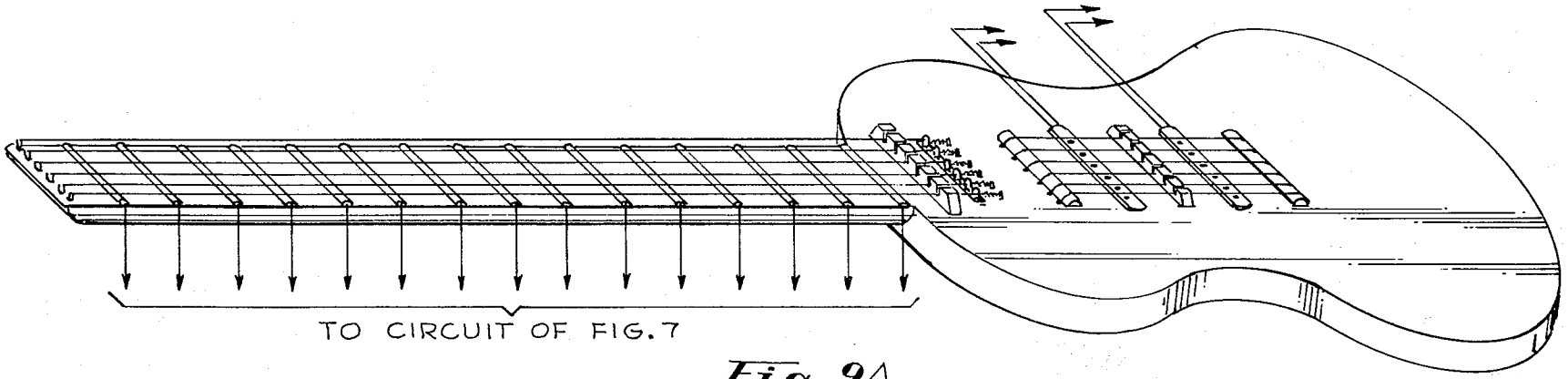

In FIG. 9C, linear potentiometer 420 has slider arm 422. Arm 422 has string 424 connected thereto. String 424 is held in tension by spring 426. Arm 422 is limited in its travel by stop 428. Electrical connections are made to potentiometer 420 by means of terminals 430, 432 and 434. The slider arm of potentiometer 420 is electrically connected to terminal 432.

Figure 9D:
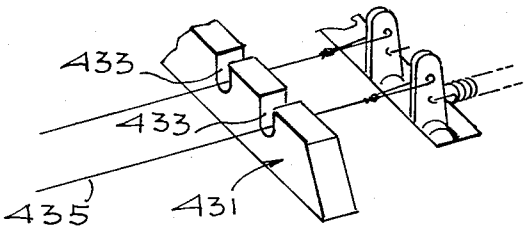
Figure 9E:
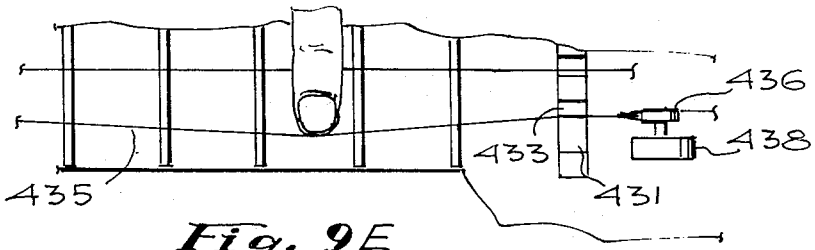

The stops 412 and 428 may be part of the "guitar" body, as can be seen in FIG. 9D. In FIG. 9D, guide 430 has slots 432 therein for the passage of strings 434 therethrough. As can be seen clearly in FIG. 9E, sideward displacement, or "bending", of string 434 causes it to press against the sides of slot 432 and the sideward motion is translated into a rectilinear pulling force on actuator arm 436 of potentiometer 438, causing a resistance change which is detected in the pitch-bend detector of FIG. 10 and produces a voltage change at the output thereof for feeding to associated voltage-controlled oscillators, such as 246 and 248 in FIG. 7.

Each potentiometer is arranged as a voltage divider with its slider more-or-less centered when at rest. Under this condition, it is presumed that the user has made the appropriate tuning adjustments to the associated V.C.O., in FIG. 7, as required. Analog gate 274 (which can be ¼ of a CMOS 4066) is closed as a result of a high level at its control input. This high level exists when the associated neck string is not touched.

Figure 10:
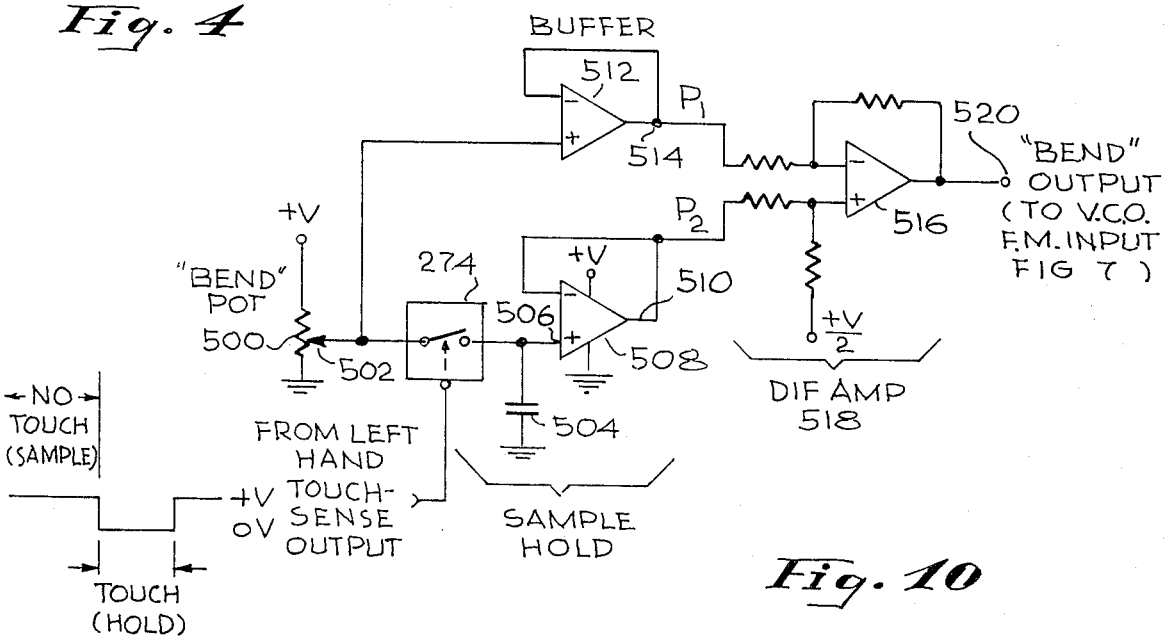
FIG. 10 is a schematic diagram of a tone "bending" circuit for use in the apparatus of FIG. 9A.

With gate 274 closed, a path from the associated potentiometer's slider is provided to the associated "bend" detector, such as that of FIG. 10. In FIG. 10 "bend" potentiometer 500 has its slider 502 connected to capacitor 504 and the non-inverting input terminal 506 of OP-AMP 508, a very high input impedance buffer using one quarter of a T.I. TL084, for example. The resulting equivalent value is available at the output terminal 510 of buffer 508 and is designated $P_2$. Simultaneously, the potentiometer's level is presented directly to a similar OP-AMP, Buffer 512 and the same level is available at its output 514, and is designated $P_1$. $P_1$ and $P_2$ are provided to the inverting and non-inverting inputs, respectively, of OP-AMP 516 configured as a differential amplifier 518. Since $P_1$ and $P_2$ are of the same voltage value, the differential amplifier 518 can be seen to have a common-mode input, and therefore maintains a quiescent value at its output as determined by its biasing, which would ordinarily by at (+V/2. This value is applied to its associated, pre-tuned, V.C.O.'s F.M. inputs (V.C.O.'s 246, 248 on FIG. 7).

Assuming now, that time and temperature effects have somewhat changed the mean (rest) value of the bend pot, 500, it can be appreciated that $P_1$ and $P_2$, while displaying a change proportional in magnitude to the pot's change, will nevertheless remain the same relative to one another; therefore the quiescent value of buffer 516 remains unchanged, and the associated V.C.O.'s tuning-integrity is maintained.

Now, if the bend pot is intentionally displaced as will be the case when the performer applies the normal pitch-bend technique to the string, gate 274 is opened, since the touch sensing circuit has provided a low level to gate 274's control input; thereby opening the path between the bend pot, 500 and the capacitor 504, buffer 508 circuit. Capacitor 504, however, has retained a charge equivalent to the previous value provided by the bend pot 500 and this equivalent value remains at $P_2$ (within the limitations of capacitor 504's leakage and other circuit leakage paths). Amplifier 508, gate 274 and capacitor 504 can be viewed as a sample-hold circuit. Meantime, buffer 512 passes the new value presented by the bend pot 500 and is in turn presented at $P_1$. $P_1$ and $P_2$ and $P_2$ now are dissimilar and the differential appears amplified at the output terminal 520 of differential amplifier 516 affecting a proportional de-tuning of its associated V.C.O.'s, hence, accomplishing pitch-bending.

A third condition to be considered in this analysis is when the performer does in fact touch the string, as in a normal playing mode, but chooses not to effect a pitch bend condition. In this circumstance, gate 274 is again opened, and for so long as capacitor 504 can reasonably store its previous charge, $P_1$ and $P_2$ will again remain similar in values, and amplifier 516 remains at its quiescent state. With proper attention paid to capacitor 504's capacitive value and its leakage, as well as leakage paths in its associated circuits (namely buffer 508), stability can be maintained long enough in a normal playing mode before capacitor 504's discharge can be detected as a change in V.C.O. pitch. To this end, an open string condition is, as well, anticipated to occur occasionally in even an abnormally extended playing sequence. Any temporary open string condition will of course, "refresh" the charge on condenser 504, since the control input to gate 274 will go "high" when the string is released.

A final condition to be considered, is when the performer again executes a pitch bend, and in the less likely, but nevertheless possible event, the mechanical system chooses this inappropriate time to not return to its previous rest position. In this circumstance the resulting pitch deviation, if detectable, can only exist for the moment after the bend, in which the string remains touched. The first open-string reccurance will establish the new rest position of potentiometer 500, to be its new reference, and the system will operate as before. Obviously, the mean position of potentiometer 500 will have to be maintained at least within the common mode parameters of differential amplifier 518. In practice, with reasonable mechanical design, this requirement has been shown to be far less stringent than that required to keep a regular guitar string in proper tune. Without the interface circuit described, however, such string tension adjustments would be at least as critical as in a normal guitar.

Again, a method has been given to provide the tactility and operation of a normal taut-string, mechanically tuned instrument, but one that does not rely on such a string as the prime tone generator. The flexibility provided is enormous. Additionally, the resulting signal developed by the bend technique may now be applied to other devices within or outside of the system, such as volume controllers, filter controllers, waveform controllers and the like. Further, the signal can be arranged to modulate the pitch down in frequency, as well as up, as is ordinarily obtained from the conventional stringed instrument by means of simple inversion.

The output of VCO's 246 and 248 are coupled to voltage controlled amplifiers 550 and 552, respectively. Control inputs for VCA's 550 and 552 are derived from envelope generators 276 and 278, respectively.

The output signals from VCA's 550 and 552 are coupled to summer 554 which provides the composite tone to output terminal 556.

This circuit for the "e" string is repeated for the B, G, D, A and E strings, as can be seen in FIG. 7.

While a particular embodiment of my invention has been shown and described it will be evident to those skilled in the art that modifications and variations may be made without departing from the spirit and scope of my invention. It is the purpose of the appended claims to cover all such modifications and variations.

I claim:

1. A guitar-like electronic musical instrument including: an electronic tone generating circuit and control means for controlling said tone generating circuit, said control means including an intentionally damped vibratory element;

said control means including, in addition, a neck control element;

a potentiometer mechanically coupled to said neck control element and having a slider arm responsive to transverse displacement of said neck control element to change its position, and having a slider-arm terminal at which a variable voltage appears in response to the change in position of said slider arm;

an electronic gate having an input terminal coupled electrically to said slider-arm terminal and having an output terminal and a control terminal;

a touch sensing circuit coupled electrically to said neck control element and responsive to the touching of such element to produce an output signal;

means for coupling said output signal from said touch sensing circuit to said control terminal of said electronic gate;

said gate being responsive to said output signal from said touch sensing circuit to produce a closed condition, whereby said voltage at said slider-arm terminal appears at the output of said gate;

a first amplifier having a first non-inverting input terminal and a first output terminal;

a second amplifier having a second non-inverting input terminal and a second output terminal;

said first non-inverting terminal being electrically coupled to said slider arm terminal;

said second non-inverting terminal being connected to said output terminal of said electronic gate;

a storage capacitor coupled between said second non-inverting input terminal and reference potential;

a differential amplifier having first signal and second signal input terminals and a difference signal output terminal;

said first output terminal of said first amplifier being connected to said first signal input terminal;

said second output terminal of said second amplifier being coupled to said second signal input terminal;

and means for coupling said difference signal output terminal to said tone generating circuit.

2. Apparatus according to claim 1 in which said tone generating means includes a voltage controlled oscillator having an F-M input terminal, said difference signal output terminal of said differential amplifier being connected to said F-M input terminal of said voltage controlled oscillator.

3. A guitar-like electronic musical instrument including: an electronic tone generating circuit and control means for controlling said tone generating circuit, said control means including an intentionally damped vibratory element;

said control means including, in addition, a plurality of neck control elements each including an electrically conductive metallic string and a plurality of electrically conductive metallic frets associated with each metallic string and positioned for electrical contact with its respective string upon manual depression of said string in the region of said fret;

a priority encoder having input terminals coupled to each of said frets and having output terminals less in number than said input terminals;

first commutating means having active outputs coupled to each of said frets for sequentially applying a potential to said frets;

second commutating means having active output terminals;

latching means having input and output terminals, said input terminals being coupled to respective output terminals of said priority encoder and said latching means being responsive to signals from said second commutating means to pass to its output terminals signals from said priority encoder;

D to A converting means having input terminals connected to respective ones of the output terminals of said latching means and having an output terminal;

said electronic tone generating circuit including voltage controlled oscillator means having input and output terminals, one of said input terminals of said voltage controlled oscillator means being connected to said output terminal of said D to A converter;

voltage controlled amplifier means having signal input terminals coupled to said output terminals of said voltage controlled oscillator means, and having a control voltage input terminal and having an output terminal;

envelope generator means having an output terminal connected to said control voltage input terminal of said voltage controlled amplifier means and having a snub input terminal;

neck control element touch sensing means including a flip-flop having first and second input terminals, first and second output terminals and a reset terminal;

a clock pulse generating circuit having an output terminal;

said first and second input terminals of said flip-flop being coupled to said output terminal of said clock pulse generating circuit for the application of inverted and non-inverted clock pulses respectively to said input terminals of said flip-flop, said reset terminal being coupled to said second commutating means;

first gating means having input terminals coupled to said output terminals of said latching means and to an output terminal of said flip-flop and having an output terminal;

second gating means having first and second input terminals and an output terminal;

body-sited touch-sensing means coupled to said first input terminal of said second gating means;

said output terminal of said first gating means being coupled to said second input terminal of said second gating means;

said output terminal of said second gating means being coupled to said snub input terminal of said envelope generator; and, means coupled to said second commutating means and to said body-sited touch sensing means for producing a strobe signal for said latching means.

4. Apparatus according to claim 3 in which said voltage controlled oscillator means includes a plurality of voltage controlled oscillators each having input and output terminals, one of each of said input terminals of said voltage controlled oscillators being connected to said output terminal of said D to A converter;

said voltage controlled amplifier means including a plurality of voltage controlled amplifiers equal in number to said plurality of voltage controlled oscillators and each having signal input terminals coupled to the output terminals of a respective one of said voltage controlled oscillators and each having a control voltage input terminal and having an output terminal;

said envelope generator means including a plurality of envelope generators equal in number to the number of voltage controlled oscillators and each having an output terminal connected to the control voltage input terminal of respective one of said voltage controlled oscillators and having a snub input terminal and a transducer input terminal;

a plurality of banks of picking strings, each string in each bank having a transducer coupled thereto for producing an output signal upon the picking of its associated picking string, each of said transducers being connected to said transducer input terminal of a respective one of said envelope generators;

all of the envelope generators connected to the transducers in a selected bank of strings in said plurality banks of strings producing at their respective output terminals, in response to respective output signals from respective transducers coupled to respective strings in said selected bank of strings, voltages having similar envelopes.

* * * * *